US008532967B2

(12) United States Patent
Torrens et al.

(10) Patent No.: US 8,532,967 B2
(45) Date of Patent: Sep. 10, 2013

(54) EXECUTING A UTILITY IN A DISTRIBUTED COMPUTING SYSTEM BASED ON AN INTEGRATED MODEL

(75) Inventors: Richard Ian Torrens, Calgary (CA); Conrad Mark Gierer, Calgary (CA); Trevor Graham Tonkin, Cochrane (CA); Errol Goberdhansingh, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 671 days.

(21) Appl. No.: 12/545,215

(22) Filed: Aug. 21, 2009

(65) Prior Publication Data

US 2011/0040533 A1 Feb. 17, 2011

Related U.S. Application Data

(60) Provisional application No. 61/234,256, filed on Aug. 14, 2009.

(51) Int. Cl.
*G06F 9/455* (2006.01)

(52) U.S. Cl.
USPC ..... 703/10

(58) Field of Classification Search
USPC ..... 703/10, 11, 1, 2, 9; 700/104; 709/205, 709/203, 227; 707/104.1; 702/18; 370/216; 718/105
See application file for complete search history.

(56) References Cited

U.S. PATENT DOCUMENTS 6,519,553 B1 * 2/2003 Barnette et al. ..... 703/2
7,590,984 B2 * 9/2009 Kaufman et al. ..... 718/105
8,117,314 B2 * 2/2012 Croft et al. ..... 709/227
2003/0031123 A1 * 2/2003 Gilmour et al. ..... 370/216
2003/0177187 A1 * 9/2003 Levine et al. ..... 709/205
2003/0236822 A1 * 12/2003 Graupner et al. ..... 709/203
2004/0244006 A1 12/2004 Kaufman
2005/0273305 A1 * 12/2005 Thalhammer-Reyero ..... 703/11
2007/0094002 A1 4/2007 Berstis
2007/0112547 A1 5/2007 Ghorayeb et al.
2007/0179768 A1 8/2007 Cullick et al.
2007/0180451 A1 8/2007 Ryan et al.
2007/0299643 A1 12/2007 Guyaguler et al.
2008/0033656 A1 * 2/2008 Herwanger ..... 702/18
2008/0065362 A1 * 3/2008 Lee et al. ..... 703/10
2008/0133194 A1 * 6/2008 Klumpen et al. ..... 703/10

(Continued)

FOREIGN PATENT DOCUMENTS

WO 2008055188 A3 5/2008

OTHER PUBLICATIONS

Ghorayeb et al., "A general purpose controller for coupling multiple reservoir simulations and surface facility networks", SPE 2003.*

(Continued)

*Primary Examiner* — Kandasamy Thangavelu

(74) *Attorney, Agent, or Firm* — Colin Wier; Rodney Warfford

(57) ABSTRACT

An integrated model based on plural underlying models relating to corresponding aspects of subterranean formation development is provided. A utility is created to perform a function using the integrated model. The utility is assigned to execute in a distributed computing system having a plurality of computer node. Computations performed by the utility are distributed across the plurality of computer nodes, where the computations are related to simulations using the integrated model.

22 Claims, 7 Drawing Sheets

(56) References Cited

U.S. PATENT DOCUMENTS

| | | | | |
|---|---|---|---|---|
| 2008/0235280 | A1* | 9/2008 | Schoen et al. | 707/104.1 |
| 2008/0262802 | A1* | 10/2008 | Halabe et al. | 703/1 |
| 2009/0113327 | A1 | 4/2009 | Pogrebinsky et al. | |
| 2009/0138245 | A1* | 5/2009 | Appleyard | 703/2 |
| 2009/0281776 | A1* | 11/2009 | Cheng et al. | 703/2 |
| 2009/0306947 | A1* | 12/2009 | Davidson | 703/2 |
| 2010/0082142 | A1* | 4/2010 | Usadi et al. | 700/104 |

OTHER PUBLICATIONS

Examination Report dated Dec. 8, 2011 for corresponding GB Application No. 1013074.8.

Examination Report dated Nov. 22, 2010 for corresponding GB Application No. 1013074.8.

Examination Report dated Oct. 1, 2012 for corresponding GB Application No. 1013074.8.

* cited by examiner

Distributed Computing Workflow

Integrated Asset Modeling

EXECUTING A UTILITY IN A DISTRIBUTED COMPUTING SYSTEM BASED ON AN INTEGRATED MODEL

CROSS-REFERENCE TO RELATED APPLICATION

This claims the benefit under 35 U.S.C. §119(e) of U.S. Provisional Application Ser. No. 61/234,256, filed Aug. 14, 2009, which is hereby incorporated by reference.

BACKGROUND

To recover fluids such as hydrocarbons from a subterranean formation, one or more wells are drilled into the subterranean formation, and various equipment and facilities are provided at the earth surface to enable the recovery of fluids from the subterranean formation and distribution to target locations. To enhance efficiency and to optimize operations associated with development of subterranean formations, modeling is often performed. Modeling involves creating models of various aspects associated with a subterranean formation development. For example, a reservoir model can be used to model properties of the subterranean formation, including any reservoirs in the subterranean formation, such that fluid flow in the subterranean formation can be simulated. Other types of models include a model of a surface network of pipelines and other equipment, a model of facilities used to store and/or deliver subterranean fluids, and/or other models. Based on such models, simulations can be performed using simulators.

In some cases, performing complex engineering studies involves running numerous simulations. Conventionally, these simulations are run sequentially leading to excessive runtimes. More recently, technology has emerged to allow concurrent simulations—however, such technology has tended to be very task specific. A more flexible and convenient approach is currently not available in the oil and gas domain.

SUMMARY

In general, according to an embodiment, an integrated model based on plural models relating to corresponding aspects of a subterranean formation development is provided. A utility is set up to perform a function using the integrated model. The utility is assigned to execute in a distributed computing system having a plurality of computer nodes. Computations performed by the utility are distributed across the plurality of computer nodes, where the computations are related to simulation using the integrated model.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

Figure 1:
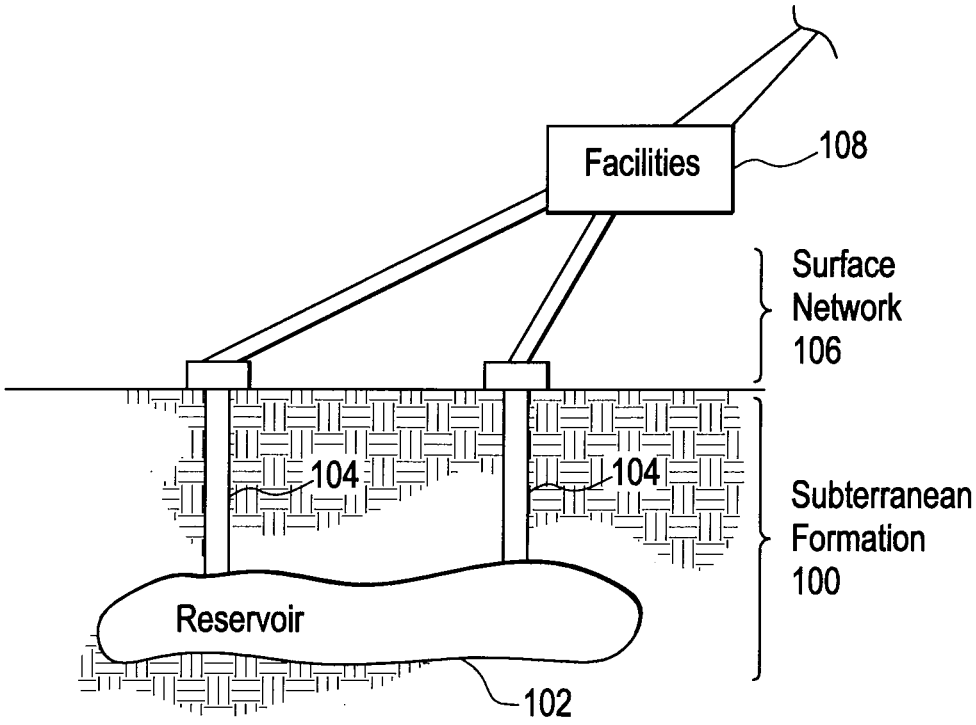
FIG. 1 illustrates an exemplary arrangement that includes a subterranean formation having a reservoir from which fluids can be extracted, where the arrangement of FIG. 1 can be modeled according to an embodiment.

FIG. 1 illustrates an exemplary arrangement that includes a subterranean formation 100 that has a reservoir 102 that contains fluids (e.g., hydrocarbons, gas, freshwater, etc.). As shown in FIG. 1, one or more wellbores 104 are drilled into the subterranean formation 100 to intersect the reservoir 102. Completion equipment can be installed in each of the wellbores 104 to allow for recovery of fluids from the reservoir 102 into the wellbores 104.

During operation, fluids from the reservoir 102 are extracted through the wellbores 104 to a surface network 106 that has various wellhead equipment as well as other components, including pipelines and so forth. Moreover, various facilities 108 are also provided, where the facilities 108 are used to store extracted facilities, or to distribute the extracted fluids to remote locations.

Instead of extracting fluids from the reservoir 102, an alternative implementation can cause fluids to be injected into a reservoir 102, such as to perform carbon dioxide sequestration, or sequestration of other types of fluids.

The process and mechanism associated with producing and/or injecting fluids into a subterranean formation is referred to as subterranean formation development. Various aspects of the subterranean formation development can be modeled using respective models. For example, a reservoir model can be used to model the subterranean formation 100, including the reservoir 102, for predicting fluid flows in various parts of the subterranean formation 100. A surface network model can also be used to model the surface network 106 of pipelines and other equipment, and a facility model can be used to model the facilities 108, which can include storage equipment to store extracted subterranean fluids as well as further pipelines to deliver the subterranean fluids to remote locations. Other models associated with subterranean formation development can also provided, including an economic model that is used to model the economic aspects of subterranean formation development (e.g., model involving costs, revenues, and other economic indicators of the subterranean formation development).

In accordance with some embodiments, the models of the various aspects of a subterranean formation development can be integrated to form an integrated asset model. An integrated asset model is useful for analyzing any interactions between the different aspects of the subterranean formation development, such as interactions between fluid flow in the subterranean formation 100 and fluid flow at the surface network 106 or at the facilities 108. It is noted that the facilities 108 can be shared by several different fields, which may have different properties. The integrated asset model can model interactions between a facility model and multiple sets of reservoir and surface network models (which correspond to the multiple fields).

Note that different integrated asset models can be developed, with each integrated asset model having different combinations of underlying models.

Various simulation workflow utilities can also be set up to perform corresponding functions using the integrated asset models. Examples of simulation workflow utilities include a utility for performing optimization (e.g., find an optimum wellhead choke setting to maximize production of oil from a network while imposing a constraint on wellhead oil production), a utility to perform multi-variable sensitivity analysis (to detect how sensitive one variable is with respect to variations in one or more other variables), a utility to perform neural network training (to train a neural network as a proxy to a surface network model, for example), and/or other utilities.

The simulation workflow utilities can be abstracted from (is separate from) core software used to implement a system according to some embodiments. The architecture of the core software is such that adding a new utility may be easily incorporated without the need for any core software modifications. In some embodiments, the utilities can be introduced into a system for use with the core software in a "plug and play" manner. Consequently, any future extensions of the system providing the integrated asset modeling according to some embodiments can be implemented easily by adding new utilities that can be plugged into the system in a transparent manner. In this manner, utilities from different vendors can be used. Also, extensibility is provided.

Execution of such utilities involves computations related to performing multiple simulations based on corresponding integrated asset models. In many cases, performing a simulation using an integrated asset model is computationally intensive. In accordance with some embodiments, such computations can be assigned to multiple computer nodes in a distributed computing system, such that the computations can be performed in parallel for improved performance.

Figure 2:
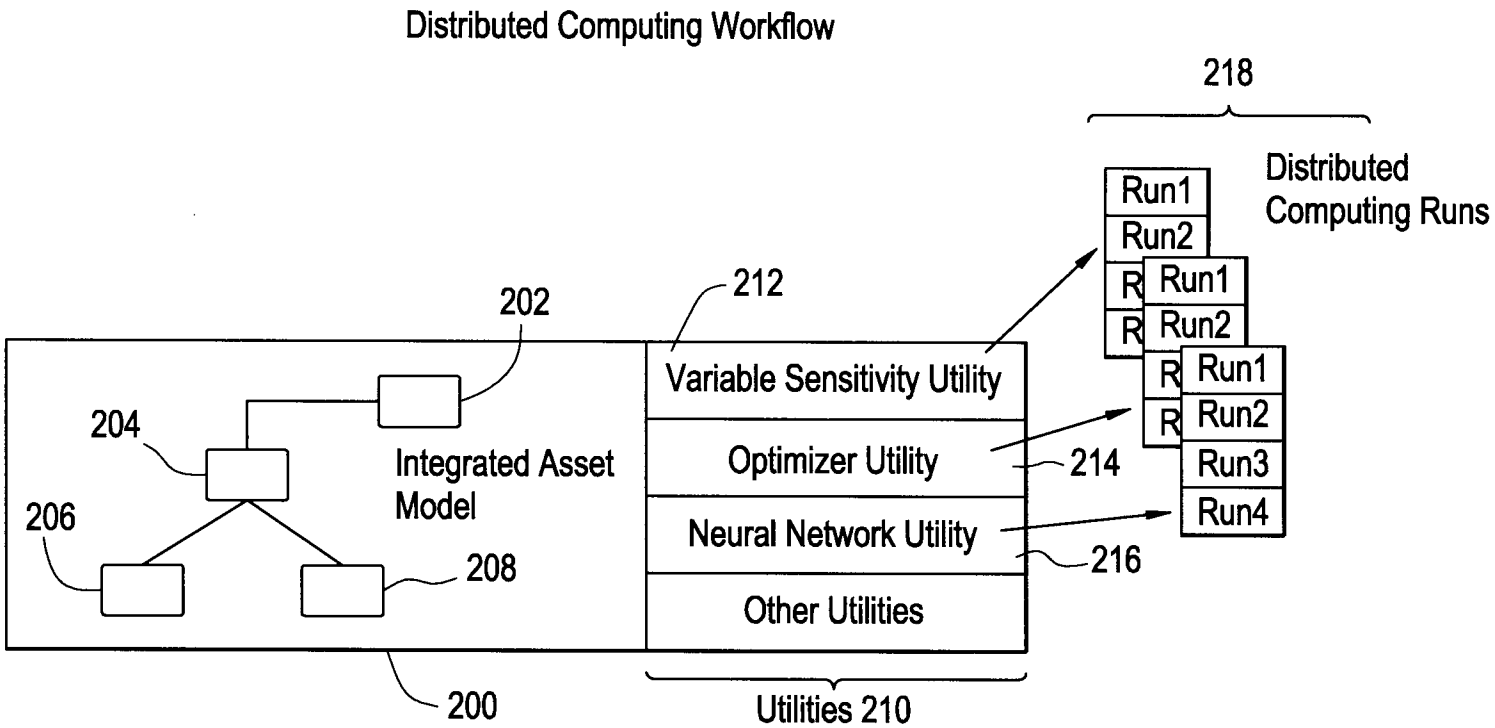
FIG. 2 is a schematic diagram of a distributed computing workflow, according to an embodiment.

FIG. 2 is a schematic diagram illustrating a distributed computing workflow according to an embodiment. FIG. 2 shows an integrated asset model 200 that is built based on various underlying models 202, 204, 206, and 208 that are coupled to each other. The models 202, 204, 206, and 208 represent different aspects of a subterranean formation development as discussed above. In addition, various utilities 210 that can use the integrated asset model 200 are shown in FIG. 2, including a variable sensitivity utility 212, an optimization utility 214, a neural network utility 216, and other utilities.

Each of the utilities 212, 214, and 216 can be assigned to multiple distributed computing runs that are executed on corresponding computer nodes of a distributed computing system. For example, the neural network utility 216 can be assigned to n computer nodes to perform n respective runs (run 1, run 2, run 3, run n shown in FIG. 2).

Figure 3:
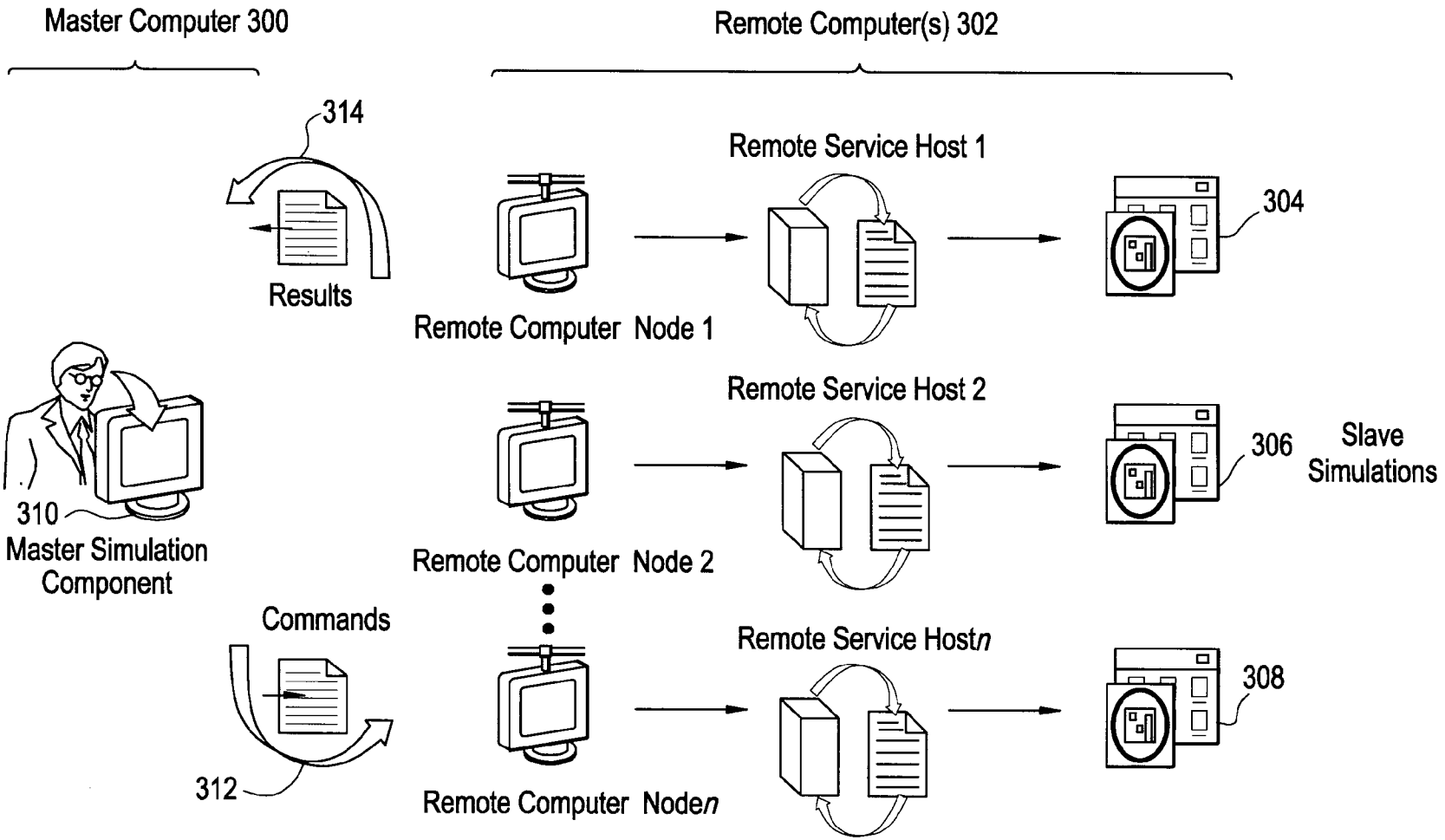
FIG. 3 is a schematic diagram of an arrangement including a master computer node and multiple remote computer nodes to perform distributed computing according to an embodiment.

As shown in FIG. 3, a distributed computing framework according to an embodiment includes a master computer node 300 and a number of remote or slave computer nodes 302. In the example of FIG. 3, n remote computer nodes (1, 2, . . . , n) are shown. Each remote computer node is associated with a remote service host (remote service host 1, remote service host 2, . . . , remote service host n). Each remote service host is a software service on the corresponding remote computer node. Generally, the remote service host interacts with a master simulation component 310 in the master computer node 300 to enable distribution of the load associated with integrated asset modeling across multiple remote computer nodes.

Based on assignment of the distributed computing runs 218 shown in FIG. 2, multiple integrated asset model slave simulations 304, 306, and 308 are performed in the respective remote computer nodes 1, 2, and n.

In the master computer node 300, the master simulation component 310 sends (at 312) commands relating to execution of the slave simulations to the remote computer nodes. Upon completion of the corresponding slave simulations 304, 306 and 308, results are returned (at 314) from the remote computer nodes back to the master simulation component 310.

Figure 4:
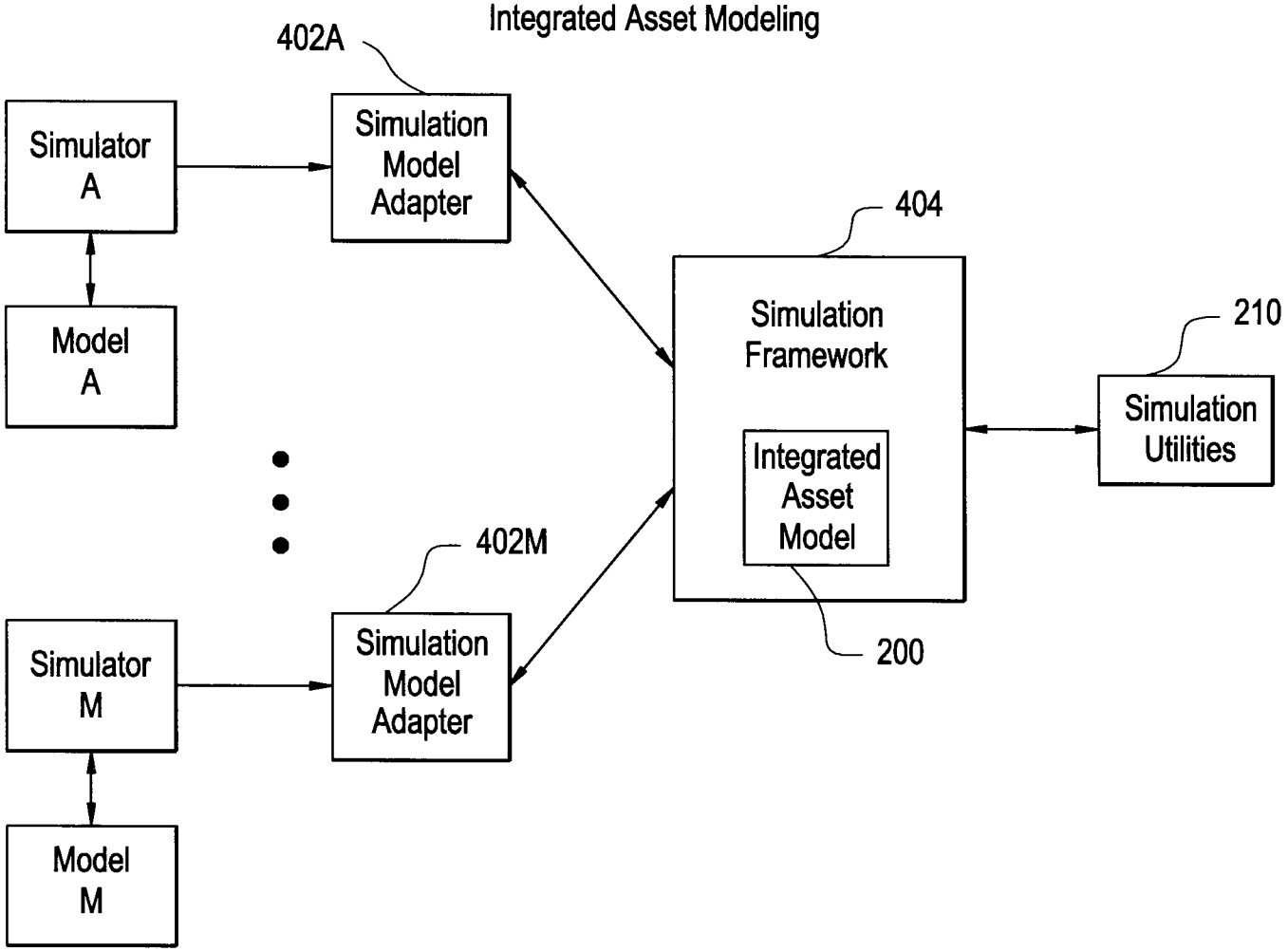
FIG. 4 is a block diagram illustrating integrated asset modeling according to an embodiment.

FIG. 4 shows an integrated asset modeling environment, which includes three core components: simulation model adapters (402A, 402M shown), a simulation framework 404, and simulation utilities 210. The components depicted in FIG. 4 can be provided in the master computer node 300 of FIG. 3, for example.

Each of the simulation model adapters 402A, 402M is associated with a corresponding simulator A, B. Each simulator A, B is used for performing simulation using a corresponding model A, M, where the models A, M represent various aspects of a subterranean formation development. The simulation model adapters 402A, 402M are used to couple disparate simulators from various engineering domains into the integrated asset modeling environment. For example, one simulation model adapter can be used for a reservoir simulator, another simulation model adapter can be used for a surface network simulator, and so forth. Each simulation model adapter extracts input and output variables from the underlying simulation model and presents the input and output variables in a generic way to the integrated asset management environment.

Each simulation model adapter differentiates between input variables (also referred to as "specifiable variables"), which may be changed by a user, and output variables (also referred to as "calculated variables"), which are the result of calculations associated with simulations using the underlying models. One example of a calculated (output) variable is the oil rate at a delivery point in a surface network, and one example of a specifiable (input) variable is the compressor duty (amount of energy consumed by compressor) in a gas plant facility. Each simulation model adapter 402A, 402M also monitors the status of each specifiable variable (input variable). When a change in the specifiable variable is detected, the underlying model is solved and published results (results from simulation using the underlying model) are updated.

The simulation framework 404 provides a mechanism for manipulating data exposed from the simulation model adapters 402A, 402M. The simulation model adapters 402A, 402M expose (or publish) the variables (input and output variables) to the simulation framework 404. Once the variables are available inside the simulation framework 404, the variables become available for use with the integrated asset model 200 that is part of the simulation framework 404.

The simulation framework 404, and more specifically, the integrated asset model 200, allows for the underlying models to be connected to each other. As an example, output variables from a surface network model (e.g., oil rate, gas rate, water rate, etc.) can be connected to the input of a gas plant facility model. When the two models are connected, any change in the connected variable in the upstream model (surface network model in this example) will result in the inputs to the downstream model being updated and solved.

The simulation framework 404 also enables reporting of variables in a predefined format (e.g., table or chart format). Also, the simulation framework 404 allows for publication of variables as key performance indicators and generation of time-based reports based on document templates. Additionally, the simulation framework 404 enables dynamic modifications of underlying simulations through the application of time-based asset management rules to modify specifiable variables. The simulation framework 404 also performs various engineering tasks through the application of the simulation utilities 210.

The simulation utilities 210 are workflow tools that allow various engineering tasks to be performed in the integrated asset modeling environment. Specifiable and calculated variables are brought into the utilities from the simulation framework 404. This creates a connection similar to the model connection of the integrated asset model 200.

Each utility performs a series of calculations to achieve a specific objective. Generally, a set of input values is specified for the specifiable variables. The input values are sent to the respective model adapters via the simulation framework 404. The simulation framework 404 and model adapters will propagate any changes to the values of the specifiable variables to the underlying simulation models (models A, M in FIG. 4) and solve them as required. The calculated variables imported into the utility are automatically updated by the simulation framework 404.

The above tasks are repeated until the objective of the utility has been achieved. Once the objective has been achieved, the results are made available to a user.

As noted above, examples of utilities include a neural network utility, an optimization utility, and a variable sensitivity utility. In one example, a neural network utility can train a neural network as a proxy to a surface network model. For example, wellhead chokes can be varied, and individual well and total network production rates resulting from the variation of the wellhead chokes are observed. By training the neural network as a proxy to the surface network model, the neural network can be used instead to produce outputs given inputs. The notion here is that the trained neural network would perform computations in a more timely and efficient manner than a simulation based on the surface network model.

Operation of the neural network utility involves three general steps. In a first step, a specifiable variable (e.g., wellhead choke diameter) is imported to the neural network utility. Also, calculated variables (e.g., flow-rates) are imported for all wells and a delivery manifold.

In a second step, a range of values (minimum value and maximum value) is specified for the specifiable variable (e.g., choke diameter). Moreover, the number of training points is specified, and the sets of input data for training the neural network are generated. The neural network training utility is then run. Each input set is sent to the underlying simulator of the surface network model, which is solved. The results are stored for later use.

Next, in a third step, the neural network is trained with the data generated in step 2.

As another example, a variable sensitivity utility can be used to validate the neural network against the actual response from the real surface network model by varying the specifiable variable (e.g., choke diameter) for a single well over a specified range for both the neural network and for the physical surface network model.

In a first step, the specifiable variable (e.g., choke diameter) is imported from the neural network model and the surface network model for a target well. Also, calculated variables (e.g., flow rates) are imported into the utility.

In a second step, the sensitivity range (minimum and maximum) for the specifiable variable is specified, and the number of sensitivity points is specified. The sensitivity analysis is then run. The variable sensitivity utility will then run the neural network and the surface network model over the sensitivity range to generate response curves.

In a third step, the utility response curves are then compared to assess the neural network performance against the surface network model.

As another example, an optimization utility can find the optimum wellhead choke settings to maximize production of oil from a surface network while imposing constraints on the wellhead oil production.

In a first step, specifiable control variables are imported into the optimization utility (such as the wellhead choke size). Also, the calculated variables required for the objective function (e.g., total oil production) and for the constraint (e.g., wellhead oil rates) are imported.

In a second step, the following are specified: the specifiable control variables range (choke size maximum and minimum), model constraints (wellhead rate maximums), and type of optimization. The optimization problem is then run. The optimization utility perturbs the underlying simulation model (e.g., surface network model), which is solved. The optimization algorithm then calculates a search direction based on the updated solution, and this is continued until the objective is minimized.

In a third step, the optimal choke settings calculated in the second step can be used in the field.

Generally, it is noted that any of the utilities discussed above performs multiple calculations based on the same simulation model using different sets of input data. If there are N calculations and M computer nodes, then the N calculations can be run on the M computer nodes, assuming $M \geqq N$.

Figure 5:
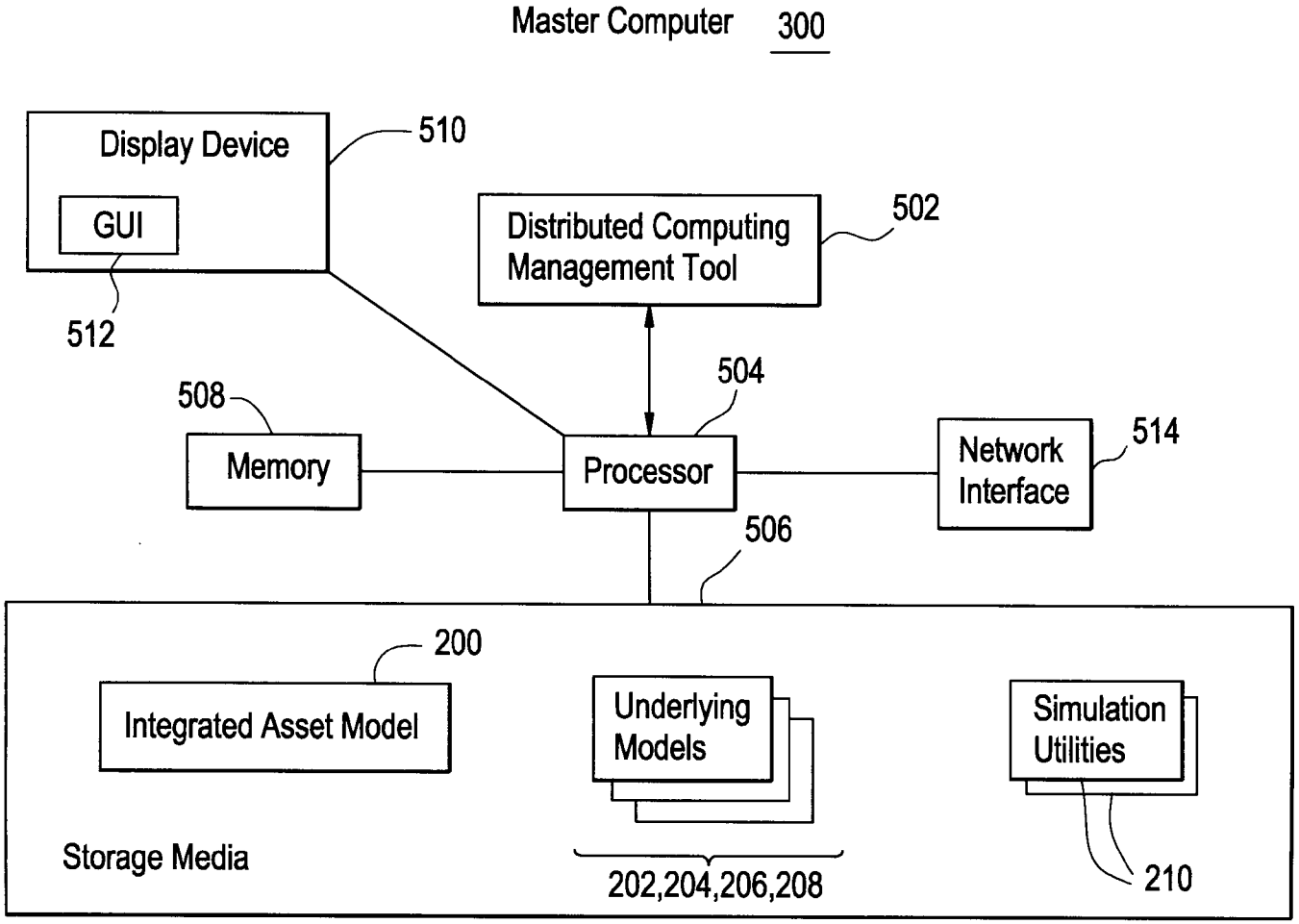
FIG. 5 is a block diagram of a master computer node according to an embodiment.

FIG. 5 shows components of the master computer node 300, according to an exemplary embodiment. The master computer node 300 includes a distributed computing management tool 502 that can be invoked by a user to load (or define) the integrated asset model (that is based on underlying models 202, 204, 206, 208). In the context of the FIG. 3 arrangement, the distributed computing management tool 502 is the master simulation component 310 of FIG. 3. The distributed computing management tool 502 also allows the user to select the number of remote (slave) computer nodes of a distributed computing system for assigning slave simulation runs.

The distributed computing management tool 502 can be software executable on a processor 504, which is connected to memory 508, display device 510, and network interface 514. The distributed computing management tool 502 upon execution causes a graphical user interface (GUI) screen 512 to be displayed in the display device 510. The GUI screen 512 allows a user to select various settings associated with the distributed computing framework using the integrated asset model 200 according to some embodiments. Also, the GUI screen 512 allows results of simulation utilities 210 to be presented to the user.

The network interface 514 enables communication between the master computer node 300 and a data network, which can be connected to remote computer nodes. Communications between the master computer node 300 and the remote computer nodes that are running slave simulations occur through the network interface 514 and the data network.

The integrated asset model 200, underlying models 202, 204, 206, and 208, and simulation utilities 210 are stored in storage media 506. The storage media 506 can be implemented with one or more disk-based storage devices and/or one or more integrated circuit storage devices.

As discussed above, the utilities can be abstracted from core software (in this case the distributed computing management tool 502). The utilities can be introduced into the system for use with the distributed computing management tool 502 in a "plug and play" manner, for flexibility and convenience.

Figure 6:
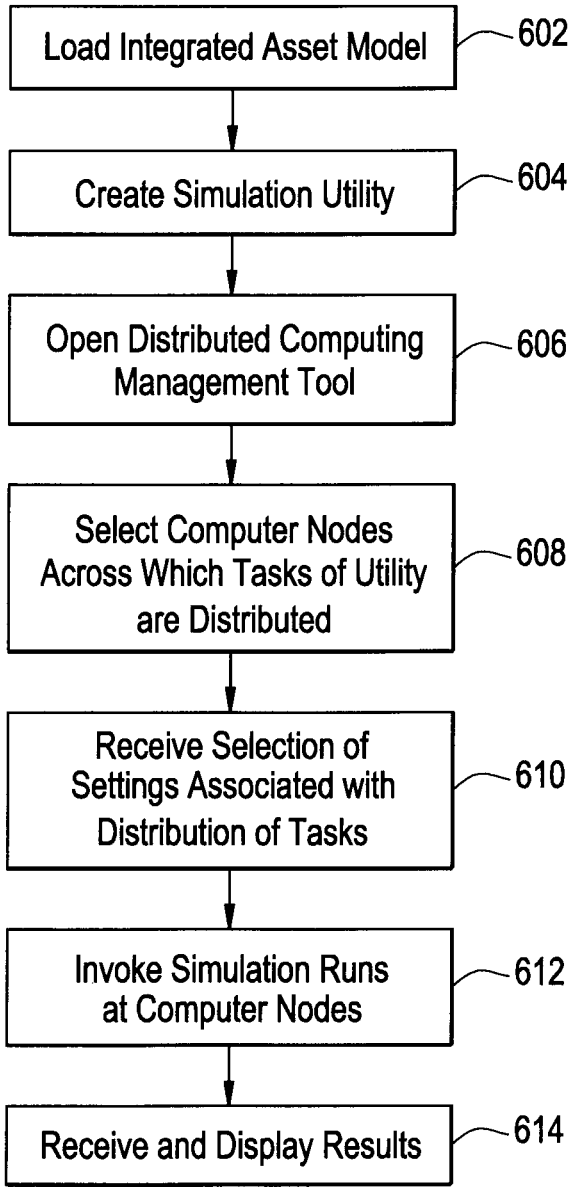
FIG. 6 is a flow diagram of a process of performing distributed computations associated with a utility according to an embodiment.

FIG. 6 is a flow diagram of a process of running a workflow utility according to an embodiment. An integrated asset model is loaded (at 602). There can be a number of integrated asset models available, and a user can select one of the integrated asset models for loading.

Next, a simulation utility is created (at 604) to perform a target function using the loaded integrated asset model. The created simulation utility can be any one of the utilities discussed above or other utilities.

The distributed computing management tool 502 (FIG. 5) is opened (at 606). Opening the distributed computing management tool 502 presents the GUI screen 512 (FIG. 5) to allow the user to make various selections associated with running the workflow utility in a distributed computing system.

The computer nodes across which tasks of the simulation utility are to be distributed are selected (at 608) in response to user selections made in the GUI screen 512. Also, the distributed computing management tool 502 receives (at 610) selection of other settings associated with the distribution of tasks of the simulation utility. For example, such other settings can include a setting to perform load balancing of the tasks of the simulation utility across the selected computer nodes. Load balancing refers to spreading work across the selected computer nodes such that optimal resource utilization, maximum throughput, and/or minimum response time can be achieved. The load balancing capabilities can be provided by the remote service hosts (FIG. 3) running in corresponding remote computer nodes.

Alternatively, a user can specifically identify which slave computer nodes are to perform which specific tasks of the simulation utility.

Next, the distributed computing management tool 502 invokes (at 612) the simulation runs on the selected computer nodes. Results of such simulation runs are received by the distributed computing management tool 502 and displayed (at 614), such as in the GUI screen 512 (FIG. 5).

Figure 7:
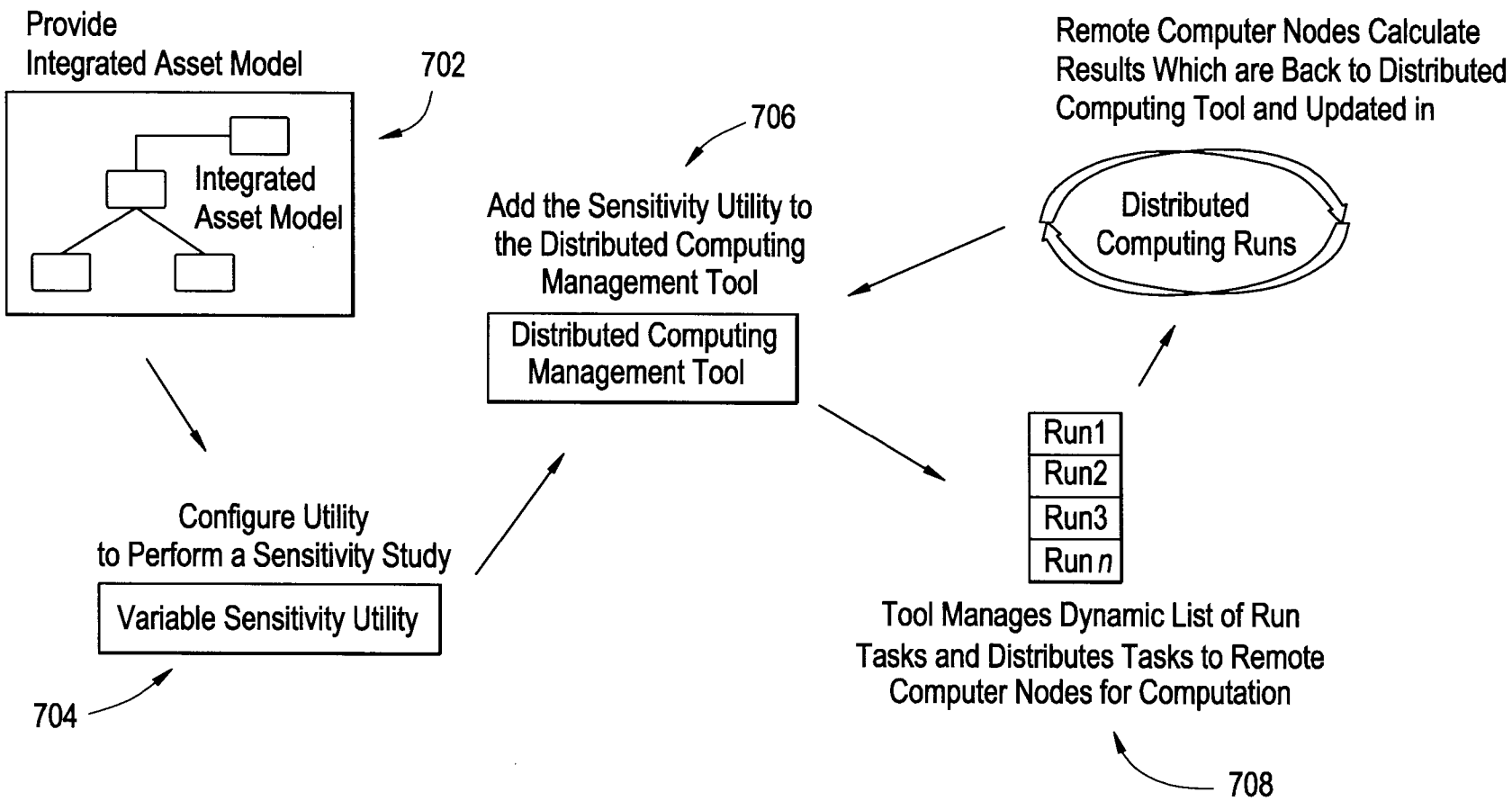
FIG. 7 is a schematic diagram of an example of providing a variable sensitivity analysis in a distributed computing framework according to an embodiment.

FIG. 7 shows an example procedure for performing a sensitivity analysis using a simulation utility based on an integrated asset model according to an embodiment. First, an integrated asset model is provided (at 702), such as by loading of a predefined integrated asset model or by creating/defining the integrated asset model. Next, a variable sensitivity analysis utility is configured (at 704) to perform the sensitivity analysis. For example, in configuring the variable sensitivity analysis utility, a number of independent variables (e.g., choke diameters) can be defined along with their respective ranges and increments, against which solutions are to be computed.

The variable sensitivity analysis utility is then added (at 706) to the distributed computing management tool 502 (FIG. 5). Note that the separation of the utilities (including the variable sensitive analysis utility) from the distributed computing management tool 502 (core software) allows for flexibility in using any current and/or future utilities with the distributed computing management tool 502. The distributed computing management tool 502 can prompt the user to select the number of computer nodes in the distributed computing system across which tasks of the variable sensitivity analysis utility are to be performed. The distributed computing management tool 502 manages (at 708) the dynamic list of run tasks of the variable sensitivity analysis utility and distributes the tasks to the remote computer nodes for computation. As each individual simulation on a remote computer node completes and results are calculated (at 710), the results are returned back to the distributed computing management tool 502.

At the distributed computing management tool 502, a master set of results is compiled based on the results returned from the remote computer nodes. Once completed, the results are reported back to the user.

Using techniques or mechanisms according to some embodiments, a generalized framework is provided for application of distributed computing to workflows in the field of integrated asset modeling. This framework provides a transparent mechanism to distribute the load associated with simulation workflows, such that enhanced productivity and speed gains can be achieved.

Instructions of software described above (including the distributed computing management tool 502, remote service hosts, and other software discussed above) are loaded for execution on a processor (such as processor 504 in FIG. 5). The processor includes microprocessors, microcontrollers, processor modules or subsystems (including one or more microprocessors or microcontrollers), or other control or computing devices. A "processor" can refer to a single component or to plural components (e.g., one or multiple central processing units in one or multiple computer nodes).

Data and instructions (of the software) are stored in respective storage devices, which are implemented as one or more computer-readable or computer-usable storage media. The storage media include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; and optical media such as compact disks (CDs) or digital video disks (DVDs).

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method comprising:

providing an integrated model based on plural underlying models relating to corresponding aspects of a subterranean formation development;

creating a simulator utility to perform a simulation function using the integrated model;

assigning, based on user input, the simulator utility to execute in a distributed computing system having a plurality of computer nodes, wherein the user input includes user selection in a graphical user interface screen of selected ones of the plurality of computer nodes for performing the simulation function;

receiving a selection indicating that load balancing of tasks associated with the simulator utility are to be performed across the selected computer nodes;

distributing computations performed by the simulator utility across the selected computer nodes, wherein the computations are related to the simulation function using the integrated model;

executing a variable sensitivity utility that varies values of at least one variable and that causes the simulator utility to be run over the values of the at least one variable to produce an output; and comparing the output against an output generated based on a corresponding one of the underlying models to assess performance of the simulator utility.

2. The method of claim 1, wherein creating the simulator utility comprises creating one of a neural network training utility and an optimization utility.

3. The method of claim 1, further comprising enabling extensibility by allowing addition of a new utility into the distributed computing system without having to modify core software in the distributed computing system.

4. The method of claim 1, wherein providing the integrated model based on the plural underlying models comprises providing the integrated model based on a connected arrangement of the plural underlying models.

5. The method of claim 4, wherein providing the integrated model based on the plural underlying models comprises providing the integrated model based on the underlying models including at least two from the group consisting of: a model of a reservoir in a subterranean formation, a model of a surface network, a model of surface facilities, and an economic model.

6. The method of claim 1, further comprising presenting the graphical user interface screen containing elements to enable user selection from among the plurality of computer nodes.

7. The method of claim 1, further comprising:

receiving results relating to the simulator utility from the selected computer nodes; and compiling the results into a master result set at a master computer node.

8. The method of claim 1, further comprising:

providing simulation model adapters corresponding to respective underlying models; and extracting input and output variables of simulators associated with the underlying models and presenting the extracted variables to a simulation framework including the integrated model.

9. The method of claim 8, further comprising:

providing the extracted variables to the simulator utility;

specifying, by the simulator utility, values for the extracted input variables;

providing the values of the extracted input variables to corresponding one or more underlying models and solving for the provided values of the extracted input variables.

10. The method of claim 9, wherein the solving provides a result for one or more extracted output variables, the method further comprising providing the result for the one or more extracted output variables to the simulator utility.

11. The method of claim 1, wherein the integrated model models interaction between a facility model and reservoir models for respective multiple fields, the facility model to model facilities that include storage equipment to store extracted subterranean fluids, and the reservoir models to model subterranean formations of the respective multiple fields.

12. A distributed computing system comprising:

a master computer node having a distributed computing management tool; and a plurality of slave computer nodes, wherein the distributed computing management tool is executable in the master computer node to:

receive a simulator utility that uses an integrated asset model based on underlying models relating to aspects of a subterranean formation development;

receive, in a graphical user interface screen, user selection of a subset of the slave computer nodes to perform simulation computations associated with the simulator utility;

receive a selection indicating that load balancing of tasks associated with the simulator utility is to be performed across the selected subset of the slave computer nodes;

distribute the simulation computations across the selected subset of the slave computer nodes;

execute a variable sensitivity utility that varies values of at least one variable and that causes the simulator utility to be run over the values of the at least one variable to produce an output; and compare the output against an output generated based on a corresponding one of the underlying models to assess performance of the simulator utility.

13. The distributed computing system of claim 12, wherein receiving the simulator utility comprises receiving one of a neural network training utility and an optimization utility.

14. The distributed computing system of claim 13, wherein the distributed computing management tool is configured to further operate with a new utility without modification of the distributed computing management tool.

15. The distributed computing system of claim 12, wherein the integrated asset model is based on a connected arrangement of the underlying models.

16. The distributed computing system of claim 15, wherein the underlying models include at least two from the group consisting of: a model of a reservoir in a subterranean formation, a model of a surface network, a model of surface facilities, and an economic model.

17. The distributed computing system of claim 12, wherein the master computer node has a display device to display the graphical user interface screen.

18. The distributed computing system of claim 12, wherein the integrated asset model models interaction between a facility model and reservoir models for respective multiple fields, the facility model to model facilities that include storage equipment to store extracted subterranean fluids, and the reservoir models to model subterranean formations of the respective multiple fields.

19. Computer-readable storage media containing instructions that upon execution cause a system having a processor to:

provide an integrated model based on plural underlying models relating to corresponding aspects of a subterranean formation development;

create a simulator utility to perform a simulation function using the integrated model;

assign, based on user input, the simulator utility to execute in a distributed computing system having a plurality of computer nodes, wherein the user input includes user selection in a graphical user interface screen of selected ones of the plurality of computer nodes for performing the simulation function;

receive a selection indicating that load balancing of tasks associated with the simulator utility are to be performed across the selected computer nodes;

distribute computations performed by the simulator utility across the selected computer nodes, wherein the computations are related to the simulation function using the integrated model;

execute a variable sensitivity utility that varies values of at least one variable and that causes the simulator utility to be run over the values of the at least one variable to produce an output; and compare the output against an output generated based on a corresponding one of the underlying models to assess performance of the simulator utility.

20. The computer-readable storage media of claim 19, wherein creating the simulator utility comprises creating one of a neural network training utility and an optimization utility.

21. The computer-readable storage media of claim 19, wherein providing the integrated model based on the plural underlying models comprises providing the integrated model based on a connected arrangement of the plural underlying models.

22. The computer-readable storage media of claim 21, wherein providing the integrated model based on the plural underlying models comprises providing the integrated model based on the underlying models including at least two from the group consisting of: a model of a reservoir in a subterranean formation, a model of a surface network, a model of surface facilities, and an economic model.

* * * * *